US008888184B2

(12) United States Patent
Meyer et al.

(10) Patent No.: US 8,888,184 B2
(45) Date of Patent: Nov. 18, 2014

(54) TILTING DEVICE FOR A CHAIR

(75) Inventors: Stefan Meyer, Freiburg (DE); Peter Wagner, Langenneufnach (DE)

(73) Assignee: Topstar GmbH, Langenneufnach (DE)

( * ) Notice: Subject to any disclaimer, the term of this patent is extended or adjusted under 35 U.S.C. 154(b) by 37 days.

(21) Appl. No.: 13/518,879

(22) PCT Filed: Nov. 10, 2010

(86) PCT No.: PCT/DE2010/001311
§ 371 (c)(1),
(2), (4) Date: Jul. 17, 2012

(87) PCT Pub. No.: WO2011/076162
PCT Pub. Date: Jun. 30, 2011

(65) Prior Publication Data

US 2013/0113253 A1 May 9, 2013

(30) Foreign Application Priority Data

Dec. 23, 2009 (DE) ..... 10 2009 060 261

(51) Int. Cl.

| | |
|---|---|
| ***A47C 1/024*** | (2006.01) |
| ***A47C 3/02*** | (2006.01) |
| ***A47C 3/026*** | (2006.01) |
| ***A47C 7/14*** | (2006.01) |
| ***A47C 3/025*** | (2006.01) |
| ***A47C 1/032*** | (2006.01) |
| ***A47C 7/44*** | (2006.01) |

(52) U.S. Cl.
CPC ..... *A47C 1/03255* (2013.01); *A47C 3/026* (2013.01); *A47C 7/14* (2013.01); *A47C 3/0252* (2013.01); *A47C 7/448* (2013.01)
USPC ..... 297/302.1; 297/325; 297/258.1; 297/344.19

(58) Field of Classification Search
CPC ..... A47C 3/30; A47C 1/03255; A47C 3/026; A47C 3/0252; A47C 3/025; A47C 7/004; A47C 1/03288
USPC ..... 297/325, 344.12, 344.19, 302.1, 258.1, 297/344.24
See application file for complete search history.

(56) References Cited

U.S. PATENT DOCUMENTS

| | | | | |
|---|---|---|---|---|
| 1,129,175 | A | 2/1915 | Desselle et al. | |
| 3,080,195 | A | 3/1963 | Berg | |
| 3,133,765 | A * | 5/1964 | Kramer | 297/446.1 |
| 3,259,431 | A * | 7/1966 | Gale | 297/303.1 |
| 3,813,069 | A | 5/1974 | Fletcher | |
| 3,863,982 | A * | 2/1975 | Sandham | 297/302.5 |

(Continued)

FOREIGN PATENT DOCUMENTS

| | | |
|---|---|---|
| DE | 20 55 684 A1 | 5/1972 |
| DE | 42 38 276 A1 | 5/1994 |

(Continued)

*Primary Examiner* — Sarah B McPartlin
(74) *Attorney, Agent, or Firm* — Gundrun E. Huckett

(57) ABSTRACT

The invention relates to a tilting device (5) for a chair, comprising a lower plate (6) and an upper plate (7). An elastic body (8) is located therebetween. The lower plate (6) has a bulge (9) in the vertical direction, by means of which the tilting device (5) is placed onto the upper end of a gas spring (2). The seat plate (3) of the chair is fastened to the upper plate (7).

19 Claims, 4 Drawing Sheets

(56) References Cited

U.S. PATENT DOCUMENTS

| | | | | |
|---|---|---|---|---|
| 4,871,208 | A * | 10/1989 | Hodgdon | 297/303.1 |
| 6,685,268 | B2 * | 2/2004 | Meyer | 297/313 |
| 7,396,080 | B2 * | 7/2008 | Suhr et al. | 297/313 |
| 7,806,479 | B2 * | 10/2010 | Jensen et al. | 297/303.1 |
| 2002/0043846 | A1 * | 4/2002 | Brauning | 297/314 |
| 2005/0099048 | A1 | 5/2005 | Schneider et al. | |

FOREIGN PATENT DOCUMENTS

| | | | |
|---|---|---|---|
| DE | 197 42 052 | A1 | 9/1998 |
| DE | 10 2005 033 052 | A1 | 2/2007 |
| EP | 1 774 871 | A1 | 4/2007 |
| EP | 1 943 927 | A2 | 7/2008 |
| JP | 63 050243 | A | 4/1988 |

* cited by examiner

TILTING DEVICE FOR A CHAIR

BACKGROUND OF THE INVENTION

The invention concerns a tilting device for a chair wherein the chair has a base with a gas spring that extends vertically in upward direction as well as a seat plate and wherein the tilting device, arranged between the base and the seat plate, comprises an elastic body that at the bottom side as well as the top side is fixedly connected to a rigid plate.

Chairs that enable a tilting movement of the seat plate about a pivot point that is located within a central seat area are known in various embodiments. The basic principle resides always in that, on the bottom side of the seat plate, a support is arranged by using an elastic body. This elastic body counteracts the tilting movement with an appropriate restoring force.

A disadvantage in connection with the known lilting devices for a chair is the generally very complex and complicated configuration with a plurality of parts.

Based on this, the invention has the object to provide a technically simple tilting device for a chair.

SUMMARY OF THE INVENTION

The technical solution is characterized by the bottom plate having a bulge extending vertically in upward direction by means of which the tilting device can be pushed onto the upper end of the gas spring, and by the seat plate being directly attachable to the top plate.

In this way, the tilting device for a chair is provided which, with respect to the technical configuration, is extremely simple and, as a whole, is comprised only of three elementary construction parts. These are the two plates as well as the elastic body positioned between the two plates. The basic idea resides in that the tilting mechanism is not a completely separate structure relative to the chair as a whole but that it is a seat support with integrated tilting mechanism. In this connection, the individual elements of the tilting device according to the invention fulfill several tasks at the same time. For example, the bottom plate is not only a bottom support for the elastic body but the bottom plate serves at the same time with its upper bulge as a receptacle for the upper end of the gas spring that projects from the base vertically upwardly. The second component, namely the top plate, not only serves as a pivotable counter plate relative to the bottom plate but the top plate serves at the same time also as a direct attachment of the seat plate of the chair. The elastic body that is mounted between the bottom plate and the top plate in a sandwich arrangement serves the tilting movement of the seat plate for generating an appropriate restoring force. With regard to mounting, this 3-component tilting device is first attached with its top plate to the bottom side of the seat plate. In this way, a fast and permanent connection of the tilting device with the seat plate is provided. This structure of tilting device and seat plate is then simply pushed onto the gas spring of the base wherein an additional fastening action is not required. As a result, this means that a constructively extremely simple seat support with integrated tilting mechanism is provided in this way which enables by means of the tilting mechanism that the chair can be tilted in the desired direction in accordance with the needs of the user.

In order to simplify the insertion of the upper end of the gas spring into the bulge of the bottom and in order to increase the frictional connection between the upper end the gas spring and the inner wall of the bulge, the bulge is at least partially of a conical configuration. This also takes into account that the upper end of the gas spring is generally conically configured. This means that the cross-sectional profiling of the bulge is matched to the profile of the upper end of the gas spring.

Preferably, the upper end of the gas spring is secured in the bulge by frictional connection. This means that no additional fastening devices are required. The tilting device is thus pushed with its bulge simply onto the upper end of the gas spring. This provides for an extremely simple assembly of the chair.

According to a further embodiment, the elastic body is closed in circumferential direction and annularly surrounds with a central opening the bulge of the bottom plate. The elastic body, in the broadest meaning, is of an annular configuration. In this connection, it has a central middle opening wherein the central axis is defined by the bulge.

According to another embodiment, the elastic body is embodied to be annular, annular with outer projections, oval, square, rectangular, or polygonal; the elastic body can be designed exactly of an annular shape in this context. This means that the restoring force of the tilting device is identical in any tilting direction. A further possibility in regard to the configuration of the elastic body resides in that it is formed with regard to its basic shape to be annular but with projections. Preferably, two projections are provided that are formed laterally relative to the longitudinal central direction of the chair. This means that the restoring force of the tilting device is laterally greater than the restoring force to the front and to the rear. A further alternative proposes that the elastic body is of an oval shape. Here also the restoring force is laterally greater than to the front and to the rear. In a square configuration of the elastic body, the restoring forces laterally as well as to the front and to the rear are identical. With respect to the diagonals, the restoring force is however greater. For a rectangular configuration of the elastic body, the restoring force is laterally greater than to the front or to the rear. In case of a polygonal configuration of the elastic body, the restoring forces can be defined in a targeted fashion in certain angle directions.

According to another embodiment, the elastic body can be embodied relative to the vertical center axis to be planar or can be conically shaped in upward or downward direction. The planar configuration of the elastic body (i.e., the upper as well as the lower boundary surfaces are positioned perpendicularly to the center axis) defines a neutral configuration in regard to the restoring force of the elastic body. In case of the conical configuration, different motoric sequences as well as sensations are experienced by the user. For example, in case of a conical configuration in the downward direction a very stable position is provided while the tilting device is more labile in case of a conical configuration in the upward direction.

The invention proposes various possibilities for attachment of the elastic body to the two plates: the elastic body is vulcanized, glued, riveted, screwed or positive-lockingly secured to the two plates. When the elastic body is secured at the plates by positive locking action, this may mean that pins with barbs are pressed into the elastic body. Also, a bayonet attachment is conceivable.

Another embodiment proposes that preferably the top plate has a pivot lever correlated therewith. The pivot lever serves for actuation of the gas spring in that the forward end of the pivot lever presses onto a corresponding valve of the gas spring.

BRIEF DESCRIPTION OF THE DRAWINGS

Different embodiments of a chair with a tilting device according to the invention will be explained in the following with the aid of the drawings. The drawings show in.

DESCRIPTION OF PREFERRED EMBODIMENTS

Figure 1A:
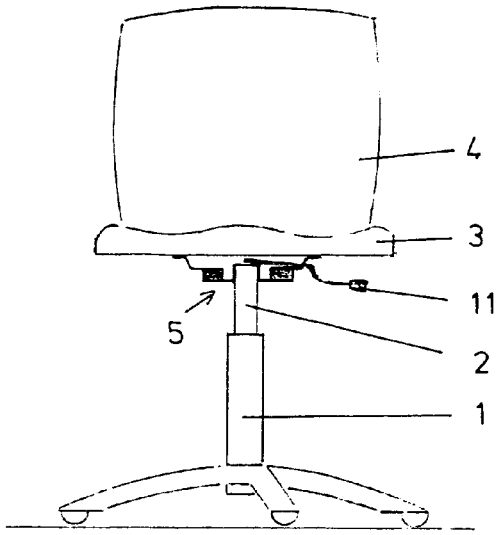
FIG. 1*a* a front view of a chair.
Figure 1B:
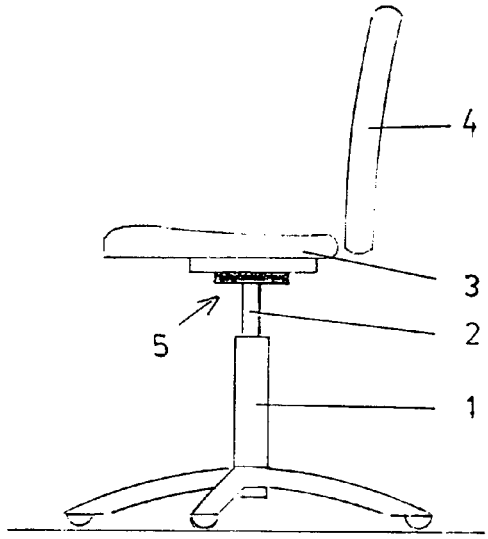
FIG. 1*b* a side view of the chair of FIG. 1*a;*

The chair that is illustrated in FIGS. 1*a* and 1*b* has a base 1. This base 1 has a gas spring 2 that extends vertically in upward direction.

Moreover, the chair has a seat plate 3. A backrest 4 is arranged thereat.

Between the base 1 and the seat plate 3 a tilting device 5 is arranged. This tilting device 5 is comprised of a bottom plate 6, a top plate 7 as well as an elastic body 8 that is positioned in a sandwich arrangement in between.

The bottom plate 6 has along the central axis a bulge 9 that extends vertically in upward direction. In the illustrated embodiment, it is initially cylindrically formed and tapers then in a conical shape in upward direction. The top plate 7 is arranged at a spacing above the bottom plate 6. Therebetween the elastic body 8 is arranged. The latter is connected with the two plates 6, 7 by vulcanization by plate sections of radial length L. However, it can also be glued, riveted or screwed to the two plates 6, 7. A fixation by positive locking action (for example, with barbs or a type of bayonet closure) is conceivable also. The elastic body 8 that is annular in the most general sense has in this connection a central opening 10 with a circumferential wall 10*a* that concentrically surrounds at a radial spacing R the bulge 9 of the bottom plate 6. The elastic body 8 has an outer circumferential wall 10*b*.

Finally, a pivot lever 11 is provided also. It is supported on the top plate 7.

The function is as follows.

The tilting device 5 is attached first with its top plate 7 to the bottom side of the seat plate 3. Subsequently, the tilting device 5 (together with the seat plate 3) is placed with its bulge 9 onto the upper end of the gas spring 2. As a result of the conical configuration, a frictional connection between the upper end of the gas spring 2 and the inner wall surface of the bulge 9 is provided. This is sufficient; no additional fastening actions are required.

Figure 2A:
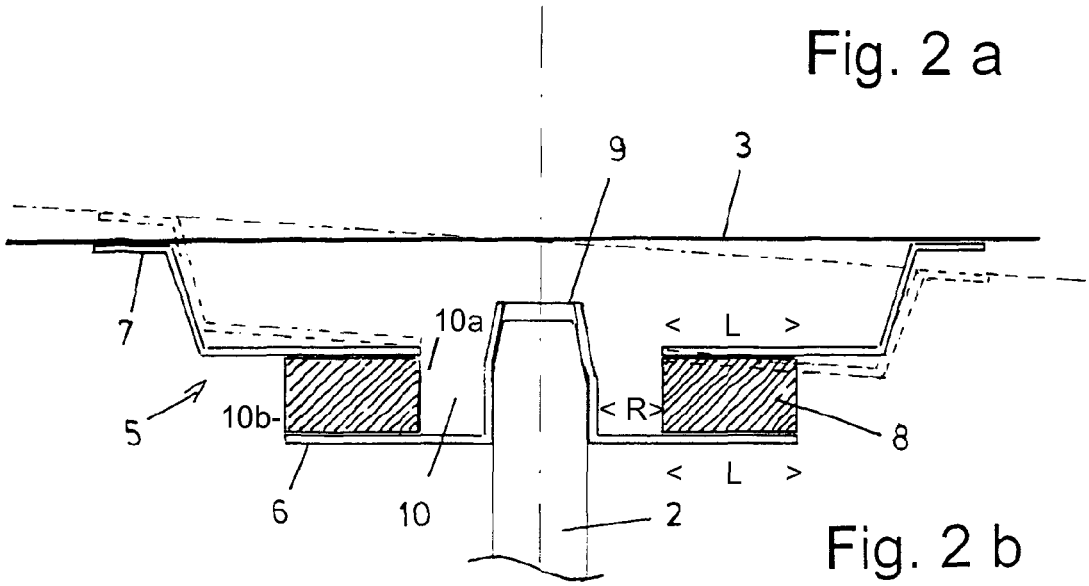
FIG. 2*a* a schematic longitudinal section view of the tilting device.
Figure 2B:
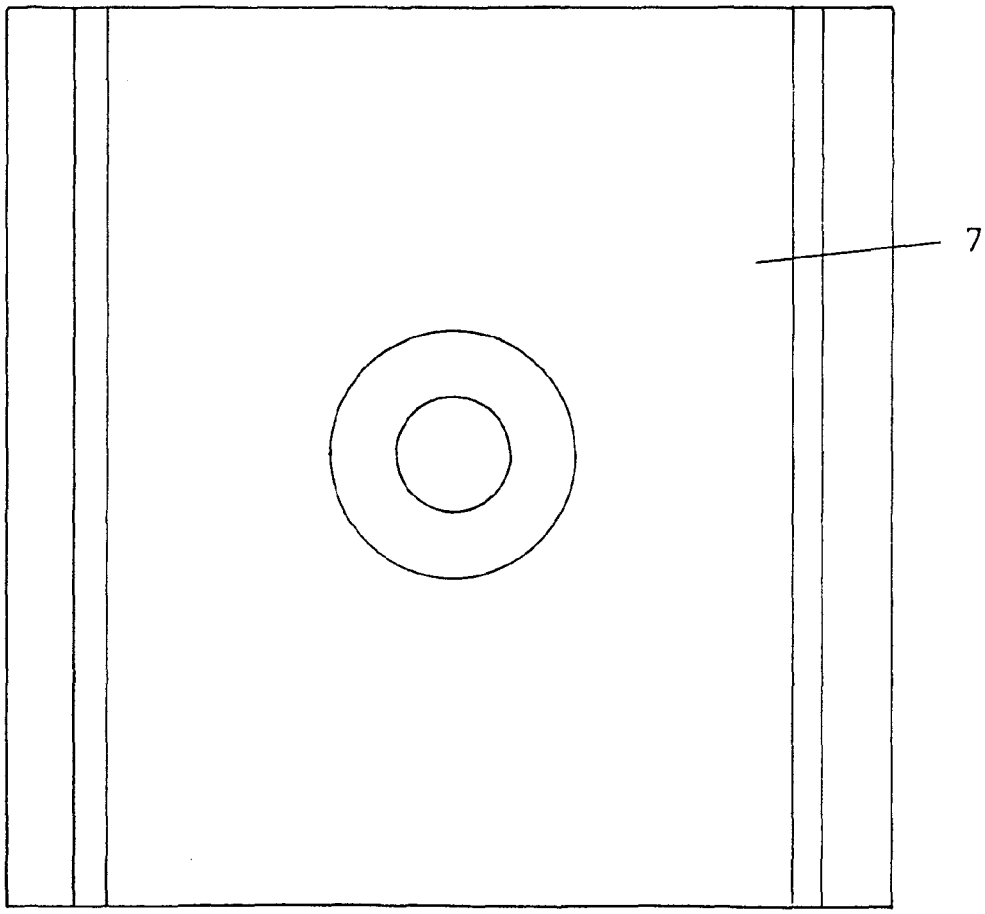
FIG. 2*b* a plan view onto the tilting device of FIG. 2*a;*
Figure 3A:
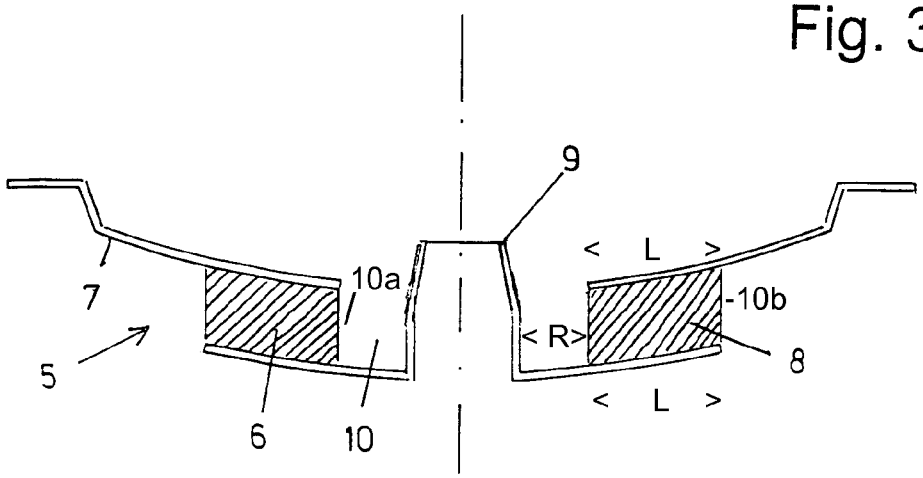
FIG. 3*a* an illustration in accordance with FIG. 2*a* but with a concave configuration of the elastic body in upward direction.
Figure 3B:
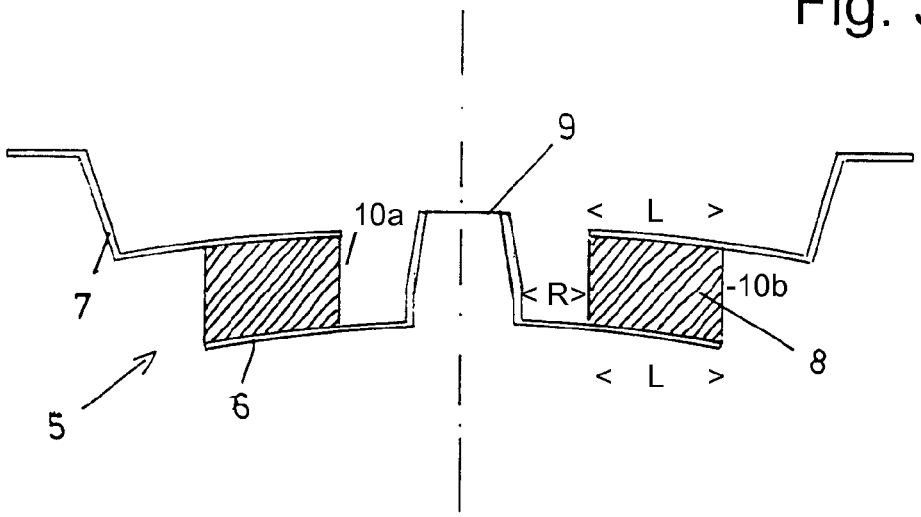
FIG. 3*b* an illustration in accordance with FIG. 3*a* wherein however the elastic body is formed concavely in downward direction.

While in FIG. 2*a* the elastic body 8 is planar, FIGS. 3*a* and 3*b* show elastic bodies 8 that in downward direction are concave (FIG. 3*b*) or in upward direction are concave (FIG. 3*a*). In this way, somewhat different tilting behaviors results.

Figure 4A:
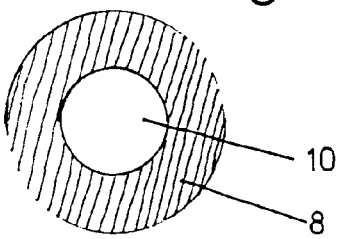
FIG. 4*a* to 4*f* different shapes of the elastic body.

FIGS. 4*a* to 4*f* show different shapes of the elastic body. In FIG. 4*a* the elastic body 8 is annular. This means that the restoring force that is exerted by the elastic body 8 in case of a tilting movement is identical relative to all angular positions.

Figure 4B:
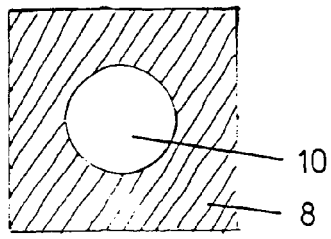

In the embodiment variant of FIG. 4*b*, the elastic body 8 is square. This means that to both sides, to the front as well as to the rear the restoring force is identical while the restoring force is somewhat greater relative to the diagonals.

Figure 4C:
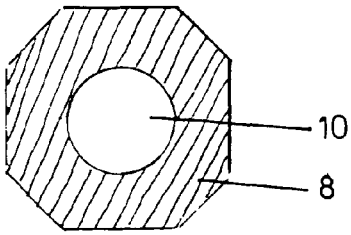

FIG. 4*c* shows a polygonal elastic body 8. In accordance with the radial thickness for different angular positions different restoring forces are provided.

Figure 4D:
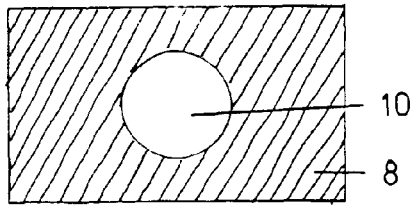

In the rectangular elastic body 8 of FIG. 4*d*, the lateral restoring forces are greater than the restoring force relative to a tilting movement to the front or to the rear. Even greater is the restoring force in the diagonal directions.

Figure 4E:
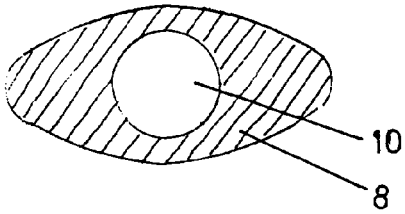

In FIG. 4*e* the elastic body 8 is oval. Here the lateral restoring forces are also greater than the restoring forces to the front and to the rear.

Figure 4F:
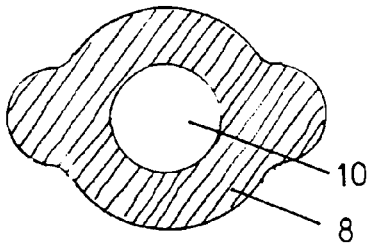

The embodiment variant of FIG. 4*f* is based on an annular elastic body 8. It has however lateral monolithically formed projections. This means that here also the restoring forces are greater in the lateral direction.

LIST OF REFERENCE CHARACTERS

1 base
2 gas spring
3 seat plate
4 backrest
5 tilting device
6 bottom plate
7 top plate
8 elastic body
9 bulge
10 central opening
11 pivot lever

What is claimed is:

1. A tilting device for a chair, the chair comprising a base with a gas spring that extends vertically in upward direction and further comprising a seat plate, the tilting device arranged between the base and the seat plate, the tilting device comprising:

an elastic body having a bottom side and a top side, wherein said bottom side and said top side are parallel to each other and wherein said bottom side and said top side extend substantially horizontally in a horizontal direction relative to a vertical center axis of said elastic body;

a first rigid plate having a first plate section that is connected to said bottom side and that extends substantially horizontally;

a second rigid plate having a second plate section that is connected to said top side and that extends parallel to said first plate section, wherein said elastic body is axially sandwiched between said first and second plate sections;

said first rigid plate having a bulge extending vertically in upward direction, wherein said bulge is configured to be pushed onto an upper end of the gas spring to secure the tilting device on the gas spring;

said second rigid plate configured to directly attach to the seat plate.

2. The tilting device according to claim 1, wherein said bulge is at least partially conically embodied.

3. The tilting device according to claim 1, wherein said bulge is secured on the upper end of the gas spring exclusively by frictional connection.

4. The tilting device according to claim 1, wherein said top and bottom sides of said elastic body are planar in said horizontal direction.

5. The tilting device according to claim 1, wherein said top and bottom sides of said elastic body are concave either in an upward direction or in a downward direction relative to said vertical center axis.

6. The tilting device according to claim 1, wherein said elastic body is vulcanized, glued, riveted, screwed or positive-lockingly secured to said first and second rigid plates.

7. The tilting device according to claim 1, comprising a pivot lever provided on said second rigid plate and configured to actuate the gas spring.

8. A chair with a tilting device according to claim 1.

9. The tilting device according to claim 1, wherein said elastic body is embodied to have a shape selected from annular, annular with outer projections, oval, square, rectangular, or polygonal.

10. A tilting device for a chair, the chair comprising a base with a gas spring that extends vertically in upward direction and further comprising a seat plate, the tilting device arranged between the base and the seat plate, the tilting device comprising:

an elastic body having a bottom side and a top side;

a first rigid plate connected to said bottom side;

a second rigid plate connected to said top side;

said first rigid plate having a bulge extending vertically in upward direction, wherein said bulge is configured to be pushed onto an upper end of the gas spring to secure the tilting device on the gas spring;

said second rigid plate configured to directly attach to the seat plate;

wherein said elastic body is closed in circumferential direction and has a central opening that annularly surrounds said bulge of said first rigid plate, wherein a circumferential wall of said central opening is spaced from said bulge in a radial direction.

11. The tilting device according to claim 10, wherein said elastic body is embodied to have a shape selected from annular, annular with outer projections, oval, square, rectangular, or polygonal.

12. The tilting device according to claim 10, wherein said bulge is at least partially conically embodied.

13. The tilting device according to claim 10, wherein said bulge is adapted to be secured on the upper end of the gas spring exclusively by frictional connection.

14. The tilting device according to claim 10, wherein said elastic body has a vertical center axis and said top and bottom sides are parallel to each other and are planar in a horizontal direction.

15. The tilting device according to claim 10, wherein said elastic body has a vertical center axis and said top and bottom sides are parallel to each other and concave either in an upward direction or in a downward direction relative to said vertical center axis.

16. The tilting device according to claim 10, wherein said elastic body is vulcanized, glued, riveted, screwed or positive-lockingly secured to said first and second rigid plates.

17. The tilting device according to claim 10, comprising a pivot lever provided on said second rigid plate and configured to actuate the gas spring.

18. The tilting device according to claim 10, wherein a height of said elastic body between said bottom side and said top side is smaller than a radial length of said elastic body between said circumferential wall of said central opening and an outer circumferential wall of said elastic body.

19. A chair with a tilting device according to claim 10.

* * * * *